US011236490B2

(12) United States Patent
Misaki

(10) Patent No.: US 11,236,490 B2
(45) Date of Patent: Feb. 1, 2022

(54) SHOVEL

(71) Applicant: SUMITOMO CONSTRUCTION MACHINERY CO., LTD., Tokyo (JP)

(72) Inventor: Youji Misaki, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/892,733

(22) Filed: Jun. 4, 2020

(65) Prior Publication Data

US 2020/0291610 A1 Sep. 17, 2020

Related U.S. Application Data

(63) Continuation of application No. PCT/JP2018/045191, filed on Dec. 7, 2018.

(30) Foreign Application Priority Data

Dec. 7, 2017 (JP) ..... JP2017-235185

(51) Int. Cl.
*E02F 9/22* (2006.01)
*E02F 3/42* (2006.01)
(Continued)

(52) U.S. Cl.
CPC ..... *E02F 9/2228* (2013.01); *E02F 3/425* (2013.01); *E02F 9/2004* (2013.01);
(Continued)

(58) Field of Classification Search
CPC ..... E02F 9/20; E02F 9/2267; E02F 9/2285; E02F 9/22; E02F 9/2228; F15B 2211/45; F15B 2211/851
See application file for complete search history.

(56) References Cited

U.S. PATENT DOCUMENTS 5,950,430 A 9/1999 Tohji et al.
8,857,169 B2 * 10/2014 Takahashi ..... F15B 11/165 60/422
(Continued)

FOREIGN PATENT DOCUMENTS

EP 2589822 5/2013
JP H10-018359 1/1998
(Continued)

OTHER PUBLICATIONS

International Search Report for PCT/JP2018/045191 dated Mar. 5, 2019.

*Primary Examiner* — Abiy Teka
(74) *Attorney, Agent, or Firm* — IPUSA, PLLC

(57) ABSTRACT

A shovel includes a lower traveling body, an upper turning body turnably mounted on the lower traveling body, an engine provided in the upper turning body, a hydraulic pump and a hydraulic oil tank provided in the upper turning body, a plurality of hydraulic actuators driven by the hydraulic pump, and a hydraulic circuit connected to the hydraulic pump, wherein the hydraulic circuit includes a plurality of control valves configured to control flows of hydraulic oil between the hydraulic pump and the plurality of hydraulic actuators, and a unified bleed-off valve configured to collectively control bleed-off flowrates of the plurality of control valves, wherein the hydraulic circuit is configured so that a discharge pressure of the hydraulic pump becomes equal to or less than a predetermined pressure during start-up of the engine.

9 Claims, 7 Drawing Sheets

(51) Int. Cl.

| | |
|---|---|
| ***E02F 9/20*** | (2006.01) |
| ***F15B 11/16*** | (2006.01) |
| *E02F 3/32* | (2006.01) |
| *G05G 5/06* | (2006.01) |

(52) U.S. Cl.
CPC ..... *E02F 9/2267* (2013.01); *E02F 9/2271* (2013.01); *F15B 11/16* (2013.01); *E02F 3/32* (2013.01); *E02F 9/2292* (2013.01); *E02F 9/2296* (2013.01); *F15B 2211/20523* (2013.01); *F15B 2211/45* (2013.01); *F15B 2211/55* (2013.01); *F15B 2211/71* (2013.01); *F15B 2211/851* (2013.01); *G05G 5/06* (2013.01)

(56) References Cited

U.S. PATENT DOCUMENTS

| | | | | |
|---|---|---|---|---|
| 9,725,884 | B2 * | 8/2017 | Hashimoto ..... | E02F 9/2282 |
| 2011/0173964 | A1 | 7/2011 | Takahashi et al. | |
| 2015/0252819 | A1 | 9/2015 | Imura et al. | |

FOREIGN PATENT DOCUMENTS

| | | | |
|---|---|---|---|
| JP | H11-081384 | | 3/1999 |
| JP | 2006-266307 | | 10/2006 |
| JP | 2010-107009 | | 5/2010 |
| JP | 2013-091953 | | 5/2013 |
| JP | 2014-227949 | | 12/2014 |
| JP | 2014227949 | A * | 12/2014 |
| WO | 2014/061741 | | 4/2014 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/045191, filed on Dec. 7, 2018 and designating the U.S., which claims priority to Japanese patent application No. 2017-235185, filed on Dec. 7, 2017. The entire contents of the foregoing applications are incorporated herein by reference.

BACKGROUND

Technical Field

The present disclosure relates to a shovel provided with a unified bleed-off valve.

Description of Related Art

A shovel provided with a hydraulic circuit including a cut-off valve (unified bleed-off valve) for collectively controlling bleed-off flowrates of multiple direction selector valves (control valves) has been suggested.

SUMMARY

According to an aspect of the present disclosure, a shovel includes a lower traveling body, an upper turning body mounted on the lower traveling body in a turnable manner, an engine provided in the upper turning body, a hydraulic pump and a hydraulic oil tank provided in the upper turning body, a plurality of hydraulic actuators driven by the hydraulic pump, and a hydraulic circuit connected to the hydraulic pump, wherein the hydraulic circuit includes a plurality of control valves configured to control flows of hydraulic oil between the hydraulic pump and the plurality of hydraulic actuators, and a unified bleed-off valve configured to collectively control bleed-off flowrates of the plurality of control valves, wherein the hydraulic circuit is configured so that a discharge pressure of the hydraulic pump becomes equal to or less than a predetermined pressure during start-up of the engine.

DETAILED DESCRIPTION

A shovel provided with a hydraulic circuit including a cut-off valve (unified bleed-off valve) for collectively controlling bleed-off flowrates of multiple direction selector valves (control valves) has been suggested. In this shovel, each control valve corresponds to one of hydraulic actuators such as a boom cylinder, a traveling hydraulic motor, a turning hydraulic motor, and the like.

In this hydraulic circuit, a pilot port of the unified bleed-off valve is connected to a pilot pump through a solenoid proportional valve. The solenoid proportional valve is configured to operate in response to a signal from a controller.

However, no disclosure has been made with regard to the opening of the unified bleed-off valve during engine start-up. When the unified bleed-off valve is closed during start-up of the engine, the shovel may not be able to start the engine. This is because the flow of the hydraulic oil discharged by the main pump having its rotation shaft coupled with the rotation shaft of the engine is shut off by the unified bleed-off valve. In other words, this is because a starter motor may not be able to rotate the rotation shaft of the engine coupled with the rotation shaft of the main pump.

In view of the above, it is desired to provide a shovel provided with a unified bleed-off valve capable of reliably starting the engine.

Figure 1:
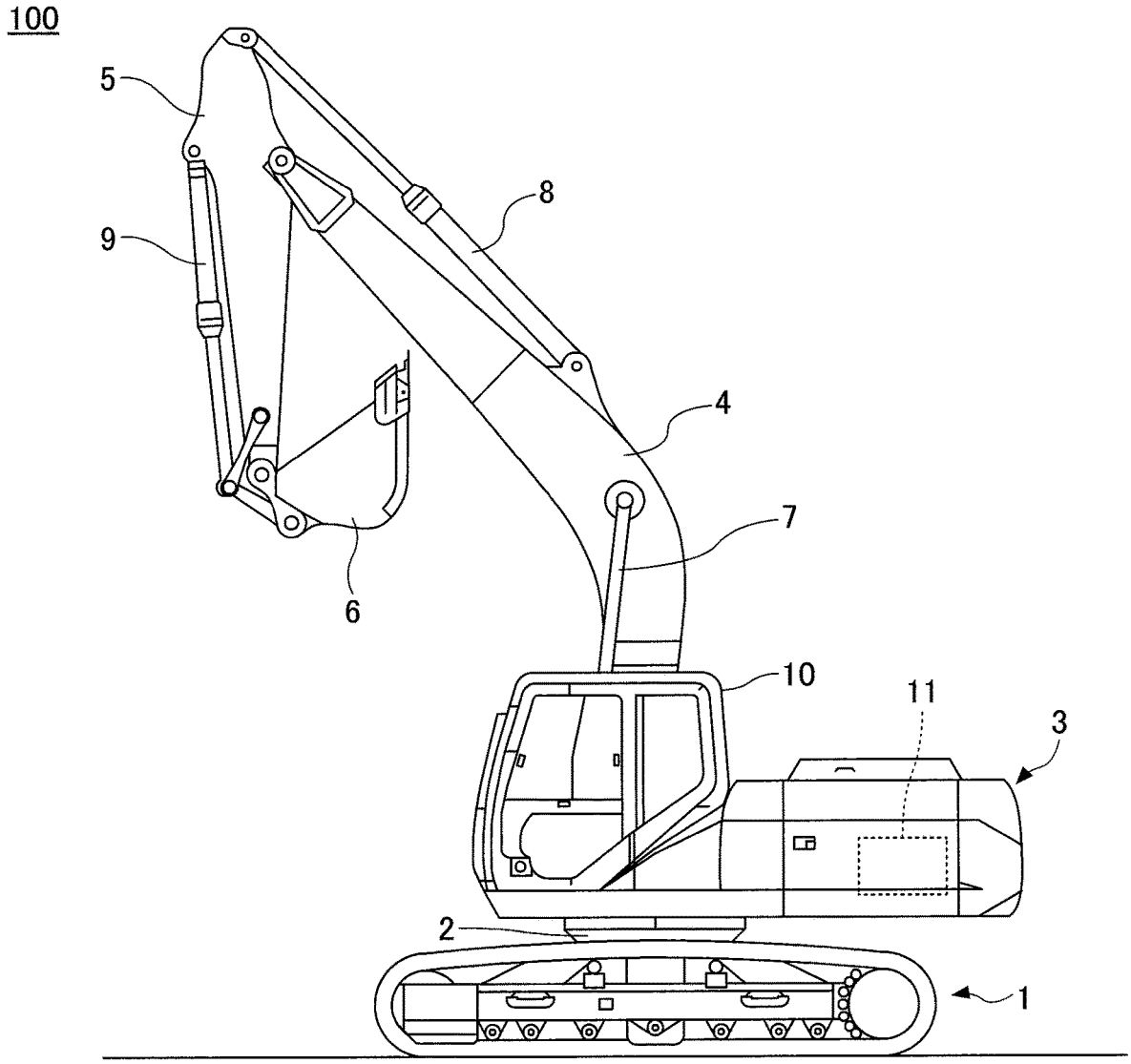
FIG. 1 is a side view illustrating an example of a shovel.

Hereinafter, a non-limiting exemplary embodiment of the present invention will be described with reference to the drawings. FIG. 1 is a side view illustrating an example of a shovel 100 as an excavator according to the present embodiment. An upper turning body 3 is mounted on the lower traveling body 1 of the shovel 100 with a turn mechanism 2. A boom 4 is attached to the upper turning body 3. An arm 5 is attached to the end of the boom 4. A bucket 6 is attached to the end of the arm 5. The boom 4, the arm 5, and the bucket 6, serving as work elements, constitute an excavating attachment, which is an example of an attachment. The boom 4 is driven by a boom cylinder 7. The arm 5 is driven by an arm cylinder 8. The bucket 6 is driven by a bucket cylinder 9. A cab 10 and an engine 11 serving as a power source are provided in the upper turning body 3.

Figure 2:
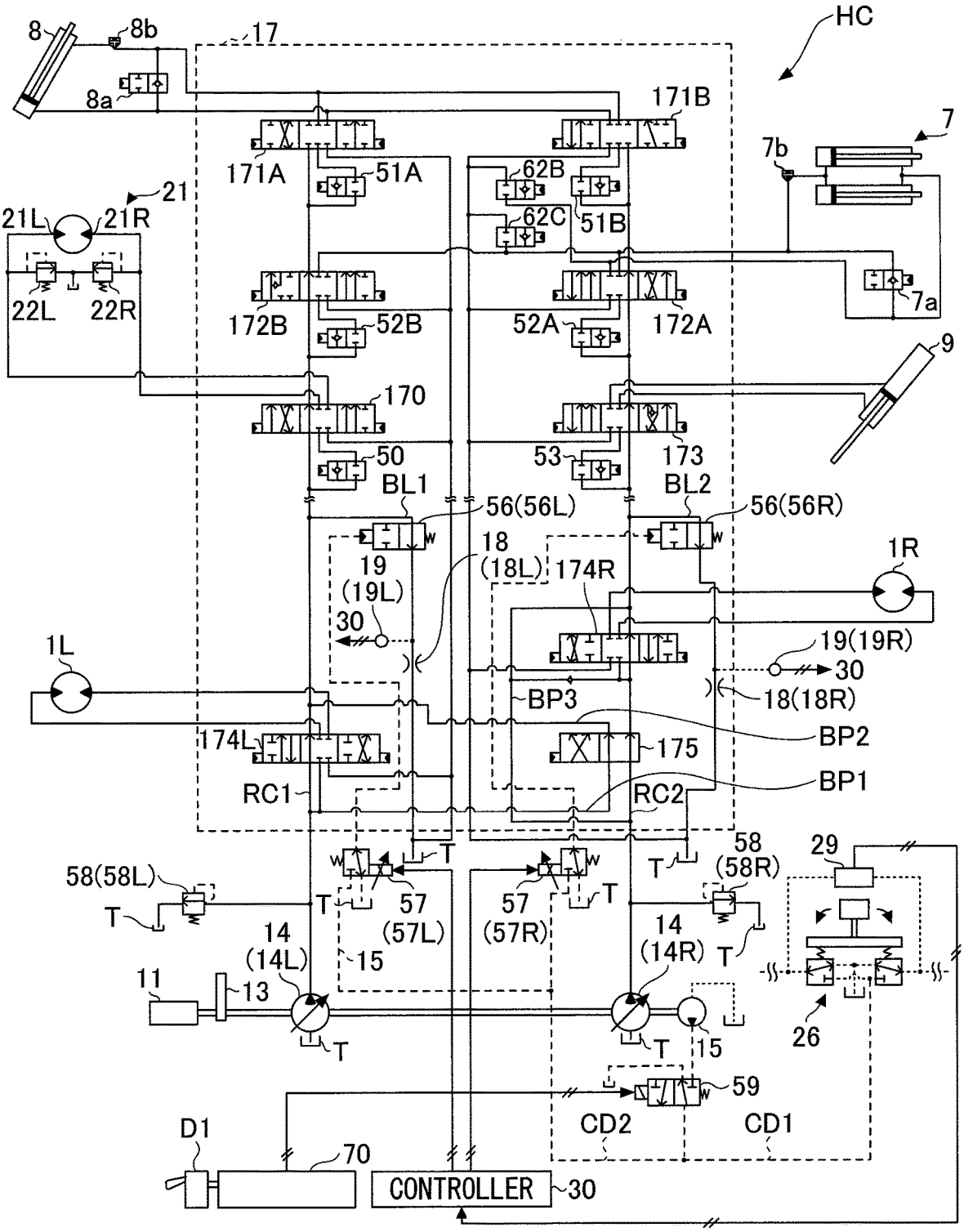
FIG. 2 is a diagram illustrating an example of a hydraulic circuit provided in a shovel.

Subsequently, a hydraulic circuit HC provided in the shovel 100 will be explained with reference to FIG. 2. FIG. 2 is a diagram illustrating an example of the hydraulic circuit HC. The hydraulic circuit HC mainly includes a main pump 14, a control valve 17, and hydraulic actuators. The hydraulic actuators mainly include a left traveling hydraulic motor 1L, a right traveling hydraulic motor 1R, the boom cylinder 7, the arm cylinder 8, the bucket cylinder 9, and a turning hydraulic motor 21.

The boom cylinder 7 can drive the boom 4 to move up and down. In the present embodiment, a regeneration valve 7*a* is connected between the bottom-side oil chamber and the rod-side oil chamber of the boom cylinder 7, and a holding valve 7*b* is connected to the bottom-side oil chamber of the boom cylinder 7. The regeneration valve 7*a* is arranged to be adjacent to the boom cylinder 7 at the outside of the control valve 17.

The arm cylinder 8 can drive the arm 5 to open and close. In the present embodiment, a regeneration valve 8*a* is connected between the bottom-side oil chamber and the rod-side oil chamber of the arm cylinder 8, and a holding valve 8*b* is connected to the rod-side oil chamber of the arm cylinder 8. The regeneration valve 8*a* is arranged to be adjacent to the arm cylinder 8 at the outside of the control valve 17.

The bucket cylinder 9 can drive the bucket 6 to open and close. A regeneration valve may be connected in an oil passage between the bottom-side oil chamber and the rod-side oil chamber of the bucket cylinder 9.

The turning hydraulic motor 21 can drive the upper turning body 3 to turn. In the present embodiment, a port 21L of the turning hydraulic motor 21 is connected to a hydraulic oil tank T through a relief valve 22L, and a port 21R of the turning hydraulic motor 21 is connected to the hydraulic oil tank T through a relief valve 22R.

The relief valve 22L is opened to discharge hydraulic oil on the port 21L side to the hydraulic oil tank T when a pressure on the port 21L side attains a predetermined relief pressure. The relief valve 22R is opened to discharge hydraulic oil on the port 21R side to the hydraulic oil tank T when a pressure on the port 21R side attains a predetermined relief pressure.

The main pump 14 is a hydraulic pump driven by the engine 11, and draws in and discharges hydraulic oil from the hydraulic oil tank T. In the present embodiment, the main pump 14 is a swash-plate variable displacement hydraulic pump, and includes a left main pump 14L and a right main pump 14R. The left main pump 14L is connected to a regulator (not illustrated). The regulator controls the geometric displacement (quantity of discharge per revolution) of the left main pump 14L by changing the swash plate tilt angle of the left main pump 14L in response to a command from the controller 30. The above explanation is also applicable to the right main pump 14R. The left main pump 14L supplies discharged hydraulic oil to a center bypass oil passage RC1, and the right main pump 14R supplies discharged hydraulic oil to a center bypass oil passage RC2.

The pilot pump 15 is a hydraulic pump driven by the engine 11, and draws in and discharges the hydraulic oil from the hydraulic oil tank T. In the present embodiment, the pilot pump 15 is a fixed displacement type hydraulic pump. However, the pilot pump 15 may be omitted. In this case, the function performed by the pilot pump 15 may be achieved by the main pump 14. Specifically, with a circuit separate from the function for providing the hydraulic oil to the control valve 17, the main pump 14 may be provided with a function for reducing the supply pressure of the hydraulic oil with a diaphragm and the like and thereafter providing the hydraulic oil to an manipulating apparatus 26, a solenoid proportional valve 57, and a unified bleed-off valve 56, and the like.

The left main pump 14L, the right main pump 14R, and the pilot pump 15 have their respective rotation shafts mechanically coupled, and the drive shafts are connected to the rotation shaft of the engine 11. Specifically, each of the rotation shafts is coupled to the rotation shaft of the engine 11 at a predetermined gear ratio via a transmission 13. Therefore, when the engine rotational speed is constant, the rotational speeds of the left main pump 14L, the right main pump 14R, and the pilot pump 15 are also constant. Alternatively, the left main pump 14L, the right main pump 14R, and the pilot pump 15 may be connected to the engine 11 via a continuously variable transmission or the like so as to be able to change their respective rotational speeds even with the engine rotational speed being constant.

The control valve 17 is a hydraulic device that includes multiple valves and oil passages. In the present embodiment, the control valve 17 is a cast body in which multiple valves are assembled, and mainly includes variable load check valves 50, 51A, 51B, 52A, 52B, and 53, the unified bleed-off valve 56, selector valves 62B and 62C, and control valves 170, 171A, 171B, 172A, 172B, 173, 174L, 174R, and 175 (hereinafter referred to as "control valve 170 and the like").

The controller 30 is, for example, a microcomputer including a CPU, RAM, and ROM, and implements various functions by causing various control programs stored in the ROM to be executed by the CPU.

The variable load check valves 50, 51A, 51B, 52A, 52B, and 53 are two-port, two-position valves that can make or break communication between each of the control valves 170, 171A, 171B, 172A, 172B, and 173 and at least one of the left main pump 14L and the right main pump 14R.

The selector valve 62B is a two-port, two-position valve that can switch whether to discharge or not to discharge, to the hydraulic oil tank T, the hydraulic oil discharged from the rod-side oil chamber of the boom cylinder 7. Specifically, in a case where the selector valve 62B is at a first position, the selector valve 62B makes communication between the rod-side oil chamber of the boom cylinder 7 and the hydraulic oil tank T, and in a case where the selector valve 62B is at a second position, the selector valve 62B breaks the communication. Also, the selector valve 62B includes a check valve that shuts off, at the first position, a flow of hydraulic oil from the hydraulic oil tank T to the rod-side oil chamber of the boom cylinder 7.

The selector valve 62C is a two-port, two-position valve that can switch whether to discharge hydraulic oil discharged from the bottom-side oil chamber of the boom cylinder 7 to the hydraulic oil tank T. Specifically, the selector valve 62C has a first position to make communication between the bottom-side oil chamber of the boom cylinder 7 and the hydraulic oil tank T and a second position to break the communication. Furthermore, the selector valve 62C includes a check valve that shuts off, at the first position, a flow of hydraulic oil from the hydraulic oil tank T to the bottom-side oil chamber of the boom cylinder 7.

Each of the control valves 170, 171A, 171B, 172A, 172B, 173, 174L, and 174R controls the direction and the flow rate of hydraulic oil flowing into and out of a corresponding hydraulic actuator. In the present embodiment, the control valves 170, 171A, 171B, 172A, 172B, 173, 174L, and 174R are six-port, three-position spool valves, and each operates in accordance with a pilot pressure input to its left or right pilot port from a corresponding manipulating apparatus 26. Specifically, the control valves 170, 171A, 171B, 172A, 172B, 173, 174L, and 174R include four ports for providing hydraulic oil to corresponding hydraulic actuators and two center bypass ports.

In the control valves 170, 171A, 171B, 172A, 172B, and 173, two center bypass ports are configured so that, irrespective of the stroke position of the spool valve, the opening areas (the passage areas of the center bypass oil passages RC1, RC2) are maintained at a predetermined value (for example, a maximum value). The control valves 174L, 174R are configured so that, in accordance with the stroke position of the spool valve, the opening areas (the passage areas of the center bypass oil passages RC1, RC2) are changed. Specifically, the control valves 174L, 174R are configured to reduce the opening areas in accordance with movement to a right position or a left position, i.e., move away from a neutral position. However, like the control valves 170, 171A, 171B, 172A, 172B, and 173, the control valves 174L, 174R may be configured so that, irrespective of the stroke position of the spool valve, the opening areas of the two center bypass ports (the passage areas of the center bypass oil passages RC1, RC2) are maintained at a predetermined value (for example, a maximum value).

The manipulating apparatus 26 is configured so as to be able to control the pilot pressure applied to the pilot port such as the control valve 170. In the present embodiment, the manipulating apparatus 26 causes a pilot pressure generated in accordance with the amount of manipulation (specifically, an manipulating angle) to act on the left or right pilot port corresponding to the direction of manipulation, using the pressure of hydraulic oil supplied from the pilot pump 15 as a source pressure (a primary-side pressure).

The control valve 170 controls the direction and flowrate of the hydraulic oil flowing into and out of the turning hydraulic motor 21. Specifically, the control valve 170 supplies hydraulic oil discharged by the left main pump 14L to the turning hydraulic motor 21.

The control valves 171A, 171B control the directions and the flowrates of hydraulic oils flowing into and out of the arm cylinder 8. Specifically, the control valve 171A supplies hydraulic oil discharged by the left main pump 14L to the arm cylinder 8. The control valve 171B supplies hydraulic oil discharged by the right main pump 14R to the arm cylinder 8. Accordingly, hydraulic oil can flow simultaneously from both the left main pump 14L and the right main pump 14R into the arm cylinder 8.

The control valve 172A controls the direction and flowrate of the hydraulic oil flowing into and out of the boom cylinder 7. Specifically, the control valve 172A supplies hydraulic oil discharged by the right main pump 14R to the boom cylinder 7. The control valve 172B causes hydraulic oil discharged from the left main pump 14L to flow into the bottom-side oil chamber of the boom cylinder 7 when a boom raising manipulation is performed with the manipulating apparatus 26. The control valve 172B can merge hydraulic oil flowing out of the bottom-side oil chamber of the boom cylinder 7 with the center bypass oil passage RC1 when a boom lowering manipulation is performed with the manipulating apparatus 26.

The control valve 173 controls the direction and the flow rate of hydraulic oil flowing into and out of the bucket cylinder 9. Specifically, the control valve 173 supplies hydraulic oil discharged from the right main pump 14R to the bucket cylinder 9.

The control valve 174L controls the direction and flowrate of the hydraulic oil flowing into and out of the left traveling hydraulic motor 1L. The control valve 174R controls the direction and flowrate of the hydraulic oil flowing into and out of the right traveling hydraulic motor 1R.

The control valve 175 is provided upstream of the control valve 174R in the center bypass oil passage RC2, and functions as a straight travel valve. Also, the control valve 175 is configured to be able to switch between: a state in which hydraulic oil discharged from the left main pump 14L is supplied to the left traveling hydraulic motor 1L and hydraulic oil discharged from the right main pump 14R is supplied to the right traveling hydraulic motor 1R; and a state in which hydraulic oil discharged from the left main pump 14L is supplied to both of the left traveling hydraulic motor 1L and the right traveling hydraulic motor 1R.

Specifically, in a case where travelling manipulation and manipulation of another hydraulic actuator are performed simultaneously, the control valve 175 causes hydraulic oil discharged from the right main pump 14R to flow, at downstream of the control valve 174L, into the center bypass oil passage RC1 through the bypass oil passage BP2. Also, the control valve 175 causes hydraulic oil discharged from the left main pump 14L to flow, at upstream of the control valve 174R, into the center bypass oil passage RC2 through the bypass oil passage BP1.

Therefore, since only the hydraulic oil discharged from the left main pump 14L is supplied to both the left traveling hydraulic motor 1L and the right traveling hydraulic motor 1R, the straightness of traveling of the lower-traveling body 1 is improved.

In contrast, in a case where only the travelling manipulation is performed, the control valve 175 allows the hydraulic oil discharged from the right main pump 14R to directly pass downstream, and causes the hydraulic oil discharged from the left main pump 14L to flow, at downstream of the control valve 174L, into the center bypass oil passage RC1 through the bypass oil passage BP1 and the bypass oil passage BP2. As a result, the hydraulic oil discharged from the left main pump 14L is supplied to the left traveling hydraulic motor 1L, and the hydraulic oil discharged from the right main pump 14R is supplied to the right traveling hydraulic motor 1R.

Therefore, the traveling performance of the lower traveling body 1 is improved.

In the center bypass oil passage RC1, the control valves 170, 172B, and 171A are arranged in tandem in an order from the upstream side (i.e., a side closer to the left main pump 14L). In the present embodiment, hydraulic oil is supplied in parallel to the control valves 170, 172B, and 171A from the left main pump 14L through the center bypass oil passage RC1. In other words, irrespective of the stroke position of each of the control valves 170 and 172B, the hydraulic oil discharged from the left main pump 14L can be supplied to the control valve 171A located at the most downstream position through the center bypass oil passage RC1. Specifically, each of the control valves 170 and 172B makes communication through the center bypass oil passage RC1 irrespective of the stroke position. That is, the control valves 170 and 172B are configured so that the opening area of the center bypass port is maintained at the maximum.

The center bypass oil passage RC1 is terminated at the control valve 171A located at the most downstream position of the center bypass oil passage RC1. In other words, on the downstream side of the control valve 171A, there is no target to supply the hydraulic oil through the center bypass oil passage RC1.

The center bypass oil passage RC1 may be configured to be blocked by a plug or the like on the downstream side of the control valve 171A. In this case, the center bypass oil passage RC1 penetrates not only the control valves 170 and 172B but also the control valve 171A.

In the center bypass oil passage RC2, the control valves 173, 172A, and 171B are arranged in tandem in an order from the upstream side (i.e., a side closer to the right main pump 14R). In the present embodiment, hydraulic oil is supplied in parallel to the control valves 173, 172A, and 171B from the right main pump 14R through the center bypass oil passage RC2. In other words, irrespective of the stroke position of each of the control valves 173 and 172A, the hydraulic oil discharged from the right main pump 14R can be supplied to the control valve 171B located at the most downstream position through the center bypass oil passage RC2. Specifically, each of the control valves 173 and 172A makes communication through the center bypass oil passage RC2 irrespective of the stroke position. That is, the control valves 173 and 172A are configured so that the opening area of the center bypass port is maintained at the maximum.

The center bypass oil passage RC2 is terminated at the control valve 171B located at the most downstream position of the center bypass oil passage RC2. In other words, on the downstream side of the control valve 171B, there is no target to supply the hydraulic oil through the center bypass oil passage RC2.

Like the center bypass oil passage RC1, the center bypass oil passage RC2 may be configured to be blocked by a plug or the like on the downstream side of the control valve 171B. In this case, like the center bypass oil passage RC1, the center bypass oil passage RC2 penetrates not only the control valves 173, 172A but also the control valve 171B.

The unified bleed-off valve 56 operates in response to a command from the controller 30, and can collectively control the bleed-off flow rates of multiple control valves. Hereinafter, unified control of bleed-off flowrates of multiple control valves is referred to as "unified bleed-off control". In the present embodiment, the unified bleed-off valve 56 is a normally-open type hydraulic drive valve, and includes a unified bleed-off valve 56L and a unified bleed-off valve 56R.

The unified bleed-off valve 56L is configured to collectively control the bleed-off flow rates of the control valves 170, 172B, and 171A. In the present embodiment, the unified bleed-off valve 56L is arranged in a unified bleed oil passage BL1 that branches from the center bypass oil passage RC1 between the control valve 174L and the control valve 170, and is connected to the hydraulic oil tank T.

The unified bleed-off valve 56L is a two-port, two-position spool valve that can control the discharge amount of hydraulic oil discharged from the left main pump 14L to the hydraulic oil tank T. In a case where the pilot pressure applied to the pilot port of the unified bleed-off valve 56L is equal to or less than a predetermined value P1, the unified bleed-off valve 56L is at a first position, and as the pilot pressure increases beyond the predetermined value P1, the unified bleed-off valve 56L approaches a second position, and when the pilot pressure is equal to or more than a predetermined value P2 (>P1), the unified bleed-off valve 56L is at the second position. In a case where the unified bleed-off valve 56L is at the first position, the unified bleed-off valve 56L maximizes the opening area (the passage area of the unified bleed oil passage BL1), and as the unified bleed-off valve 56L moves closer to the second position, the unified bleed-off valve 56L reduces the opening area, and in a case where the unified bleed-off valve 56L is at the second position, the unified bleed-off valve 56L shuts off the unified bleed oil passage BL1.

The unified bleed-off valve 56R is configured to collectively control the bleed-off flowrate of the control valves 173, 172A, and 171B. In the present embodiment, the unified bleed-off valve 56R is arranged in a unified bleed oil passage BL2 that branches from the center bypass oil passage RC2 between the control valve 174R and the control valve 173, and is connected to the hydraulic oil tank T.

The unified bleed-off valve 56R is a two-port, two-position spool valve that can control the discharge amount of hydraulic oil discharged from the right main pump 14R to the hydraulic oil tank T. In a case where the pilot pressure applied to the pilot port of the unified bleed-off valve 56R is equal to or less than a predetermined value P1, the unified bleed-off valve 56R is at a first position, and as the pilot pressure increases beyond the predetermined value P1, the unified bleed-off valve 56R approaches a second position, and when the pilot pressure becomes equal to or more than a predetermined value P2 (>P1), the unified bleed-off valve 56R changes to the second position. In a case where the unified bleed-off valve 56R is at the first position, the unified bleed-off valve 56R maximizes the opening area (the passage area of the unified bleed oil passage BL2), and as the unified bleed-off valve 56R moves closer to the second position, the unified bleed-off valve 56R reduces the opening area, and in a case where the unified bleed-off valve 56R is at the second position, the unified bleed-off valve 56R shuts off the unified bleed oil passage BL2.

The controller 30 controls the unified bleed-off valve 56 on the basis of the detection value of the pressure sensor 29 for detecting the amount of manipulation and the manipulation direction of the manipulating apparatus 26 including a manipulation lever and the like. Specifically, the controller 30 transmits a command to the solenoid proportional valve 57 arranged in an oil passage connecting the pilot port of the unified bleed-off valve 56 and the pilot pump 15.

The solenoid proportional valve 57 operates in response to a command from the controller 30. In the present embodiment, the solenoid proportional valve 57 is an inverse proportional electromagnetic proportional pressure reducing valve, and includes a solenoid proportional valve 57L and a solenoid proportional valve 57R. The solenoid proportional valve 57L applies a pilot pressure corresponding to a command current given by the controller 30 to the pilot port of the unified bleed-off valve 56L. The pilot pressure decreases, as the command current increases. The solenoid proportional valve 57R applies a pilot pressure corresponding to a command current given by the controller 30 to the pilot port of the unified bleed-off valve 56R. The pilot pressure decreases, as the command current increases. In this manner, the controller 30 can achieve unified bleed-off control.

The diaphragm 18 is a diaphragm that generates a negative control pressure, which is the control pressure for controlling a regulator. In the present embodiment, the diaphragm 18 includes a diaphragm 18L provided in the unified bleed oil passage BL1 and a diaphragm 18R provided in the unified bleed oil passage BL2.

The control pressure sensor 19 is a sensor for detecting the control pressure, and outputs the detection value to the controller 30. The control pressure sensor 19 includes a control pressure sensor 19L that detects a control pressure generated upstream of the diaphragm 18L and a control pressure sensor 19R that detects a control pressure generated upstream of the diaphragm 18R.

In this manner, the hydraulic circuit HC of FIG. 2 includes the unified bleed-off valves 56L, 56R that can adjust the passage areas of the unified bleed oil passages BL1, BL2. With this configuration, even if each of the control valves 170, 171A, 171B, 172A, 172B, and 173 does not have a configuration for controlling the bleed-off flowrates, the controller 30 can collectively control the bleed-off flowrates with the unified bleed-off valves 56L, 56R. Therefore, as compared with the case where each of the control valves 170, 171A, 171B, 172A, 172B, and 173 controls the bleed-off flowrate, the pressure loss in the center bypass oil passages RC1, RC2 can be reduced.

In the hydraulic circuit HC of FIG. 2, the unified bleed-off valves 56L, 56R are provided in the unified bleed oil passages BL1, BL2 branching from branch points on the upstream side with respect to the control valves 171A, 171B located at the most downstream positions in the center bypass oil passages RC1, RC2. Therefore, as compared with the case where the unified bleed-off valves 56L, 56R are on the downstream side with respect to the control valves 171A, 171B located at the most downstream positions in the center bypass oil passages RC1, RC2, the responsiveness of the unified bleed-off control can be improved. For example, the influence of residual pressure and the like in the control valves 170, 171A, 171B, 172A, 172B, and 173 can be alleviated, and the pressure (the discharge pressure of the main pump 14) of the hydraulic oil in the hydraulic circuit HC can be reduced immediately by the unified bleed-off control. However, the present invention does not exclude a configuration in which the unified bleed-off valves 56L, 56R are on the downstream side with respect to the control valves 171A, 171B located at the most downstream positions in the center bypass oil passages RC1, RC2. In the case where the unified bleed-off valves 56L, 56R are on the downstream side with respect to the control valves 171A, 171B located at the most downstream positions, the control pressure sensor 19L, 19R and the diaphragm 18L, 18R are arranged downstream of the unified bleed-off valves 56L, 56R.

The unified bleed oil passage BL1 is configured to branch off from the center bypass oil passage RC1 between the control valve 174L and the control valve 170 and to be connected to the hydraulic oil tank T. Likewise, the unified bleed oil passage BL2 is configured to branch off from the center bypass oil passage RC2 between the control valve 174R and the control valve 173 and to be connected to the hydraulic oil tank T. With this configuration, the influence of the control valves arranged downstream of the branch point is alleviated, and the operability and the responsiveness of the hydraulic actuators related to the control valves arranged upstream of the branch point are improved. In other words, the operability and the responsiveness of the left traveling hydraulic motor 1L and the right traveling hydraulic motor 1R driving the lower traveling body 1 are improved.

The unified bleed oil passage BL1 may be configured to branch off from the center bypass oil passage RC1 between the control valve 170 and the control valve 172B and to be connected to the hydraulic oil tank T. In this case, the control valve 170 located upstream of the branch point is less likely to be affected by the influence of the control valves 172B and 171A located downstream of the branch point (i.e., the influence due to, for example, residual pressure). Therefore, for example, during turn-only manipulation, the controller 30 performs unified bleed-off control using the unified bleed-off valve 56L, so that the pressure of the hydraulic oil in the hydraulic circuit HC can be changed quickly, so that the turn operation of the upper turning body 3 can be speeded up. Specifically, when the controller 30 determines that a turn-only manipulation has been performed on the basis of the detection value of the pressure sensor 29 for detecting the manipulation state of the manipulating apparatus 26, the controller 30 supplies a command current to the solenoid proportional valve 57L to execute the unified bleed-off control with the unified bleed-off valve 56L. As a result, the hydraulic oil discharged from the left main pump 14L can be quickly supplied to the turning hydraulic motor 21. Alternatively, the unified bleed oil passage BL1 may be configured to branch off from the center bypass oil passage RC1 between the control valve 172B and the control valve 171A and to be connected to the hydraulic oil tank T.

The unified bleed oil passage BL2 may be configured to branch off from the center bypass oil passage RC2 between the control valve 173 and the control valve 172A and to be connected to the hydraulic oil tank T. In this case, the control valve 173 located upstream of the branch point is less likely to be affected by the influence of the control valves 172A and 171B located downstream of the branch point (i.e., the influence due to, for example, residual pressure). Therefore, for example, during bucket-only manipulation from the idling state, the controller 30 performs the unified bleed-off control with the unified bleed-off valve 56R, so that the pressure of the hydraulic oil in the hydraulic circuit HC can be changed quickly, and the operation of the bucket 6 can be speeded up. Specifically, when the controller 30 determines that the bucket 6-only manipulation is performed on the basis of the detection value of the pressure sensor 29 for detecting the manipulation state of the manipulating apparatus 26, the controller 30 supplies a command current to the solenoid proportional valve 57R and executes the unified bleed-off control with the unified bleed-off valve 56R. As a result, the hydraulic oil discharged from the right main pump 14R can be quickly supplied to the bucket cylinder 9. In particular, a quick operation of the bucket 6 is desired in an operation for sieving out fine earth with the bucket 6 (skeleton bucket), an operation for shaking off fine earth adhered to the bucket 6, and the like. This configuration can improve the operability and the responsiveness of the hydraulic actuator in a scene in which such a quick operation is desired. Alternatively, the unified bleed oil passage BL2 may be configured to branch off from the center bypass oil passage RC2 between the control valve 172A and the control valve 171B and to be connected to the hydraulic oil tank T.

In this manner, for example, the unified bleed-off valves 56L, 56R may be arranged in the unified bleed oil passages BL1, BL2 that branch off between a control valve corresponding to a preferentially operated hydraulic actuator (for example, the turning hydraulic motor 21 or the bucket cylinder 9) and a control valve arranged adjacently downstream of that control valve. According to this configuration, the influence on the operation of the preferentially operated hydraulic actuator caused by the control valve for another hydraulic actuator is alleviated, and the operability and the responsiveness of the preferentially operated hydraulic actuator can be improved. The preferentially operated hydraulic actuator may be a hydraulic actuator for driving an auxiliary attachment (for example, a crusher, a breaker, or the like) not illustrated. The preferentially operated hydraulic actuator may be a hydraulic actuator for driving an auxiliary attachment (for example, a crusher, a breaker, or the like) not illustrated.

A relief valve 58 is configured to open when the pressure of the hydraulic oil at the primary side becomes equal to or more than a predetermined relief pressure. In the present embodiment, the relief valve 58 includes a relief valve 58L and a relief valve 58R. When the pressure of the hydraulic oil of the center bypass oil passage RC1 becomes equal to or more than the predetermined relief pressure, the relief valve 58L is configured to open to discharge the hydraulic oil in the center bypass oil passage RC1 to the hydraulic oil tank T. When the pressure of the hydraulic oil of the center bypass oil passage RC2 becomes equal to or more than the predetermined relief pressure, the relief valve 58R is configured to open to discharge the hydraulic oil in the center bypass oil passage RC2 to the hydraulic oil tank T.

A gate lock lever D1 switches the manipulating apparatus 26 to either an enabled state or a disabled state. The enabled state of the manipulating apparatus 26 means a state in which, when the operator manipulates the manipulating apparatus 26, a corresponding hydraulic actuator operates. The disabled state of the manipulating apparatus 26 means a state in which, even when the operator manipulates the manipulating apparatus 26, a corresponding hydraulic actuator does not operate.

In the present embodiment, the gate lock lever D1 is provided on the front portion at the left side of the driver's seat. When the operator pulls up the gate lock lever D1 to a lock-released state, the manipulating apparatus 26 is changed into the enabled state. When the operator pushes down the gate lock lever D1 to a locked state, the manipulating apparatus 26 is changed to the disabled state.

The gate lock valve 59 is a solenoid selector valve operating in synchronization with the gate lock lever D1. In the present embodiment, the gate lock valve 59 switches to make or break communication between the pilot pump 15 and oil passages CD1, CD2, in response to a voltage signal from an engine start circuit 70 serving as a start circuit of the shovel. The oil passage CD1 is an oil passage connecting the pilot pump 15 and the manipulating apparatus 26. The oil passage CD2 is an oil passage connecting the pilot pump 15 and the unified bleed-off valve 56. Specifically, when a voltage is applied to the gate lock valve 59, the gate lock valve 59 makes communication between the pilot pump 15 and the oil passages CD1, CD2, and when a voltage is not applied to the gate lock valve 59, the gate lock valve 59 breaks communication between the pilot pump 15 and the oil passages CD1, CD2.

Figure 3:
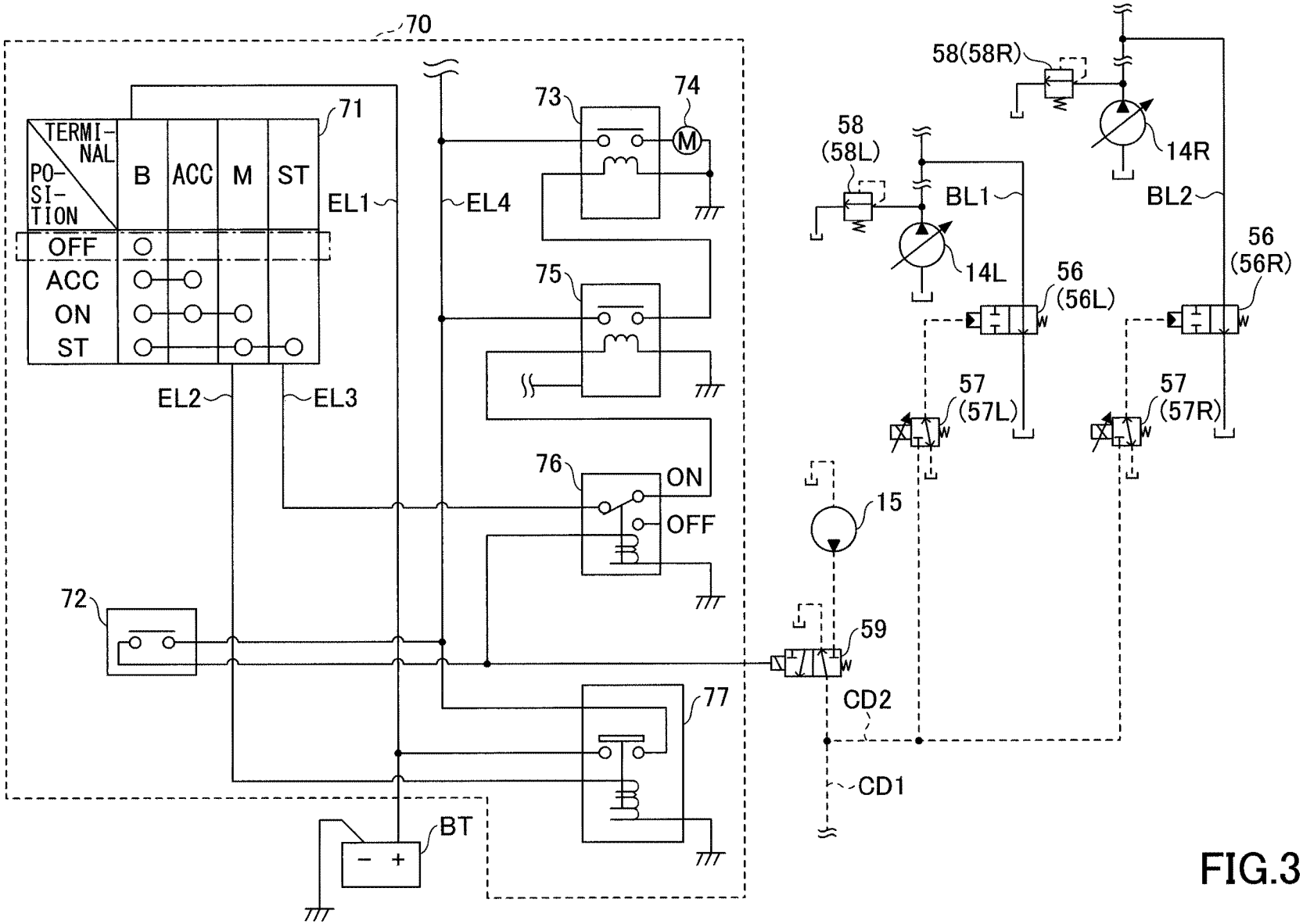
FIG. 3 is a schematic diagram illustrating an example of configuration of an engine start circuit.

The engine start circuit 70 is an electric circuit for starting the engine 11. FIG. 3 is a schematic diagram illustrating an example of configuration of the engine start circuit 70. As illustrated in FIG. 3, the engine start circuit 70 mainly includes a key switch 71, a gate lock switch 72, a starter relay 73, a starter motor 74, a safety relay 75, a starter cut relay 76, and a battery relay 77.

The key switch 71 is a switch for starting the engine 11. In the present embodiment, the key switch 71 is a switch incorporated into a key cylinder provided in the cab 10, and is configured so that a switch position is switched to any one of the OFF position, an ACC position, the ON position, and a ST position, in accordance with a rotation position of an engine key inserted into the key cylinder. However, the key switch 71 may be a switch used in an electronic key system such as a keyless entry system or a smart keyless entry system. In this case, switching of the switch position may be performed by an electric motor that operates according to remote control by the operator with a mobile key. The shovel 100 may also authenticate the operator when the shovel 100 is equipped with an electronic key system.

FIG. 3 illustrates a state of the engine start circuit 70 when the key switch 71 is at the OFF position. A frame drawn with an alternate long and short dash line represents the current switch position of the key switch 71. At the OFF position, the terminal B is not connected to any other terminal. At the ACC position, the terminal B is connected to the terminal ACC, and the first battery line EL1 is connected to an accessory line (not illustrated). At the ON position, the terminal B is connected to the terminal ACC and the terminal M, and the first battery line EL1 is connected to the accessory line and a battery relay line EL2. At the ST position, the terminal B is connected to the terminal M and a terminal ST, and the first battery line EL1 is connected to the battery relay line EL2 and a starter cut relay line EL3.

In accordance with manual manipulation of the gate lock lever D1, the gate lock switch 72 switches between a state in which a voltage can be applied to the gate lock valve 59 and a state in which a voltage cannot be applied to the gate lock valve 59. For example, when the gate lock lever D1 is pulled up to the lock-released state, the gate lock switch 72 changes into the conductive state, in which a voltage can be applied to the gate lock valve 59. Conversely, when the gate lock lever D1 is pushed down to the locked state, the gate lock switch 72 changes to the non-conductive state, in which a voltage cannot be applied to the gate lock valve 59.

The starter relay 73 switches to make or break conduction between the second battery line EL4 and the starter motor 74. In the present embodiment, the starter relay 73 is configured to be in the conductive state when the key switch 71 is switched to the ST position while the engine 11 is at a stop and the gate lock switch 72 is in the non-conductive state.

The starter motor 74 is an electric motor for rotating (cranking) the rotation shaft of the engine 11 during engine start-up.

The safety relay 75 is configured to switch to make or break conduction between the second battery line EL4 and the starter relay 73. In the present embodiment, the safety relay 75 is configured to be in the conductive state when the key switch 71 is switched to the ST position while the engine 11 is at a stop and the gate lock switch 72 is in the non-conductive state. After the engine has been started, the safety relay 75 is configured to be in the non-conductive state.

The starter cut relay 76 is configured to switch to make or break conduction between the starter cut relay line EL3 and the safety relay 75. In the present embodiment, the starter cut relay 76 is configured to make conduction between the starter cut relay line EL3 and the safety relay 75, when the key switch 71 is switched to the ST position while the engine 11 is at a stop and the gate lock switch 72 is in the non-conductive state. The starter cut relay 76 is configured to break conduction between the starter cut relay line EL3 and the safety relay 75, when the gate lock switch 72 is in the conductive state, even if the key switch 71 is at the ON position or the ST position. This is to prevent rotation of the starter motor 74.

The battery relay 77 is configured to switch to make or break conduction between the first battery line EL1 and the second battery line EL4. In the present embodiment, when the key switch 71 is at the ON position or the ST position, the battery relay 77 is configured to be in the conductive state.

As illustrated in FIG. 3, in a case where the key switch 71 is at the OFF position, i.e., the engine 11 is at a stop, the unified bleed-off valves 56L, 56R of the normally-open type are set at a first position at which the opening area is the maximum (the unified bleed oil passages BL1, BL2 have the maximum passage areas). Since no hydraulic oil is provided from the pilot pump 15 from the oil passages CD1, CD2, the pilot pressure which is the pressure of the hydraulic oil in the oil passages CD1, CD2 is still at a low level.

Figure 4:
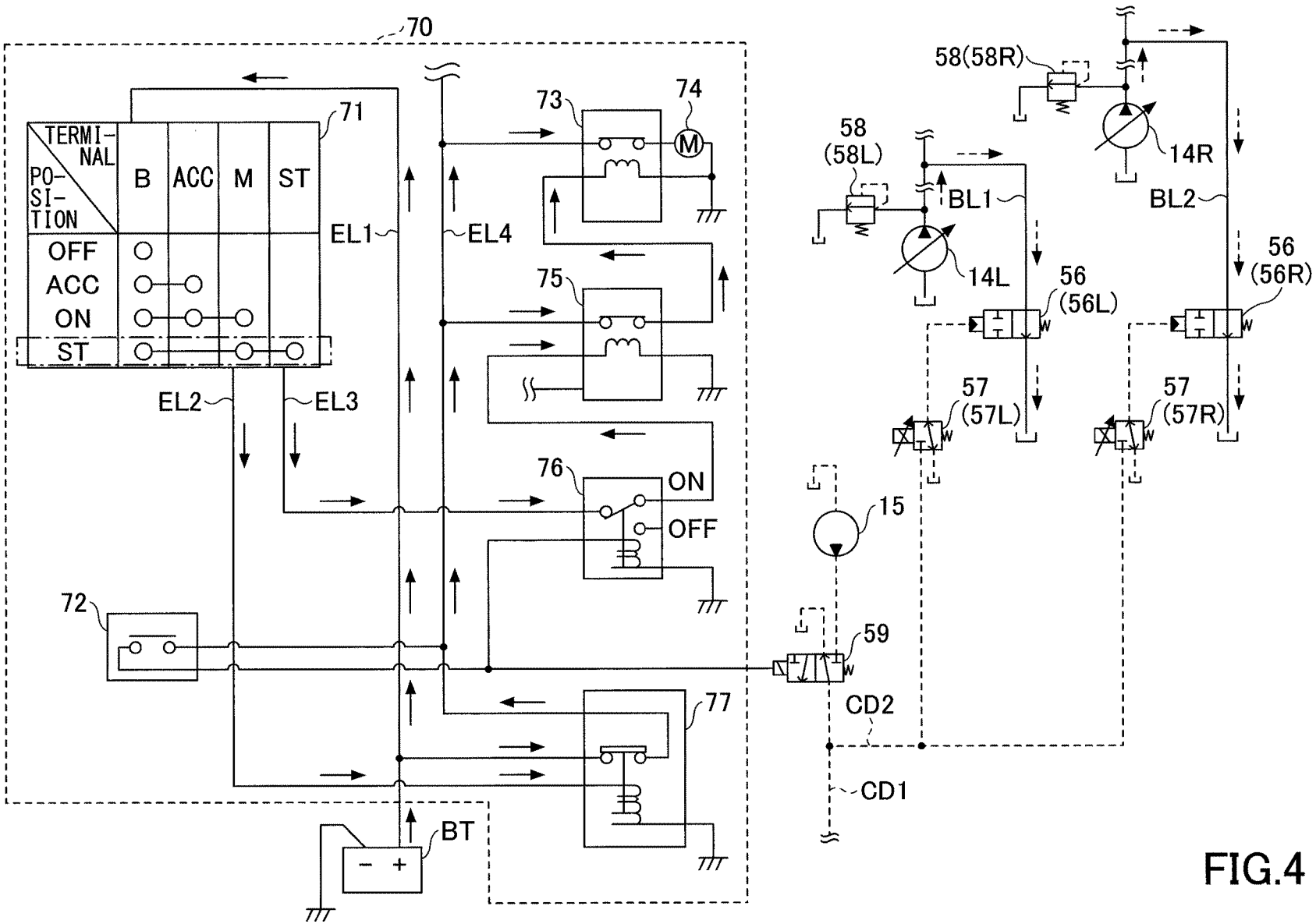
FIG. 4 is a diagram illustrating an example of a state of a hydraulic circuit during start-up of the engine.

At this occasion, when the key switch 71 is switched to the ST position, and the rotation shaft of the engine 11 is rotated by the starter motor 74, then, the rotation shaft of the main pump 14 rotates according to rotation of the rotation shaft of the engine 11, and the main pump 14 discharges hydraulic oil as illustrated in FIG. 4.

FIG. 4 illustrates a state of the engine start circuit 70 when the key switch 71 is switched to the ST position. Arrows of solid lines in FIG. 4 represent the flows of electricity, and arrows of broken lines represent the flows of hydraulic oil. The same applies to FIGS. 5 to 7. Specifically, as illustrated in FIG. 4, when the key switch 71 is switched to the ST position, the first battery line EL1 is connected to the battery relay line EL2 and the starter cut relay line EL3. When the first battery line EL1 and the battery relay line EL2 are connected, a current flows from a battery BT to the battery relay 77, and accordingly, the battery relay 77 changes to the conductive state, so that the first battery line EL1 and the second battery line EL4 are brought into conduction. When the first battery line EL1 and the starter cut relay line EL3 are connected, a current flows from the battery BT via the starter cut relay 76 to the safety relay 75, and accordingly, the safety relay 75 changes to the conductive state, so that the second battery line EL4 and the starter relay 73 are brought into conduction. When the second battery line EL4 and the starter relay 73 are brought into conduction via the safety relay 75, the starter relay 73 changes to the conductive state, so that the second battery line EL4 and the starter motor 74 are brought into conduction. When the second battery line EL4 and the starter motor 74 are in conduction, the starter motor 74 rotates the rotation shaft of the engine 11. At this occasion, the unified bleed-off valves 56L, 56R of the normally-open type are set at the first position at which the unified bleed oil passages BL1, BL2 have the maximum passage areas. Accordingly, even when the main pump 14 rotates in accordance with the rotation of the engine 11, the hydraulic oil discharged by the main pump 14 is discharged to the hydraulic oil tank T. Therefore, the discharge pressure of the main pump 14 does not increase excessively, and the engine load does not increase excessively. As a result, the starter motor 74 can rotate the rotation shaft of the engine 11 at a predetermined rotation speed or more to start the engine 11.

In this manner, the shovel 100 can reliably start the engine 11. This is because the maximum passage areas of the unified bleed oil passages BL1, BL2 at the time of the start up of the engine are basically maintained, so that the passage areas are equal to or more than a predetermined value. In other words, this is because the flow paths for discharging the hydraulic oil discharged by the main pump 14 to the hydraulic oil tank T are maintained. However, the maximum passage areas need not be necessarily maintained, and the unified bleed oil passages BL1, BL2 may have any degree of openings as long as the engine 11 can be started.

However, in a case where the gate lock switch 72 is in the conductive state, i.e., the gate lock lever D1 is pulled up to the lock-released state, the engine start circuit 70 does not allow the engine 11 to be started even when the key switch 71 is switched to the ST position. Specifically, when the gate lock switch 72 changes to the conductive state, the second battery line EL4 is connected to the starter cut relay 76. When the second battery line EL4 is connected to the starter cut relay 76, a current flows from the battery BT via the battery relay 77 and the gate lock switch 72 to the starter cut relay 76, and the starter cut relay 76 breaks the conduction between the starter cut relay line EL3 and the safety relay 75. As a result, the safety relay 75 changes to the non-conductive state, and accordingly, the starter relay 73 also changes to the non-conductive state. In this state, even when the key switch 71 is switched to the ST position, the starter motor 74 does not rotate, and the engine 11 is not started. This is to prevent the hydraulic actuators from operating when the manipulating apparatus 26 is manipulated by mistake during start-up of the engine.

When the key switch 71 is switched to the ON position after the engine 11 has been started, the starter cut relay line EL3 is disconnected from the first battery line EL1. As a result, the safety relay 75 changes to the non-conductive state and the starter relay 73 also changes to the non-conductive state. Accordingly, the starter motor 74 stops rotation.

In this state, in a case where the gate lock switch 72 is in the non-conductive state, i.e., in a case where the gate lock lever D1 is pushed down to the locked state which is a non-working state (for example, in a case where the shovel 100 is in the non-working state), the gate lock valve 59 is disconnected from the second battery line EL4. Therefore, the gate lock valve 59 does not operate, so that the pilot pump 15 and the oil passages CD1, CD2 are not brought into communication. As a result, the hydraulic oil discharged by the pilot pump 15 does not reach the solenoid proportional valve 57, and the pilot pressure applied to the pilot port of the unified bleed-off valve 56 does not increase. Accordingly, the unified bleed-off valve 56 is maintained at the first position at which the unified bleed oil passages BL1, BL2 have the maximum passage areas, and the hydraulic oil discharged by the main pump 14 is discharged to the hydraulic oil tank T. In this state, the pilot pump 15 and the oil passage CD1 are not in communication, and therefore, the manipulating apparatus 26 is in the disabled state. In other words, the hydraulic oil discharged by the pilot pump 15 does not reach the manipulating apparatus 26, and even if the manipulating apparatus 26 is manipulated, the pilot pressure applied to the pilot port such as the control valve 170 and the like does not increase.

Figure 5:
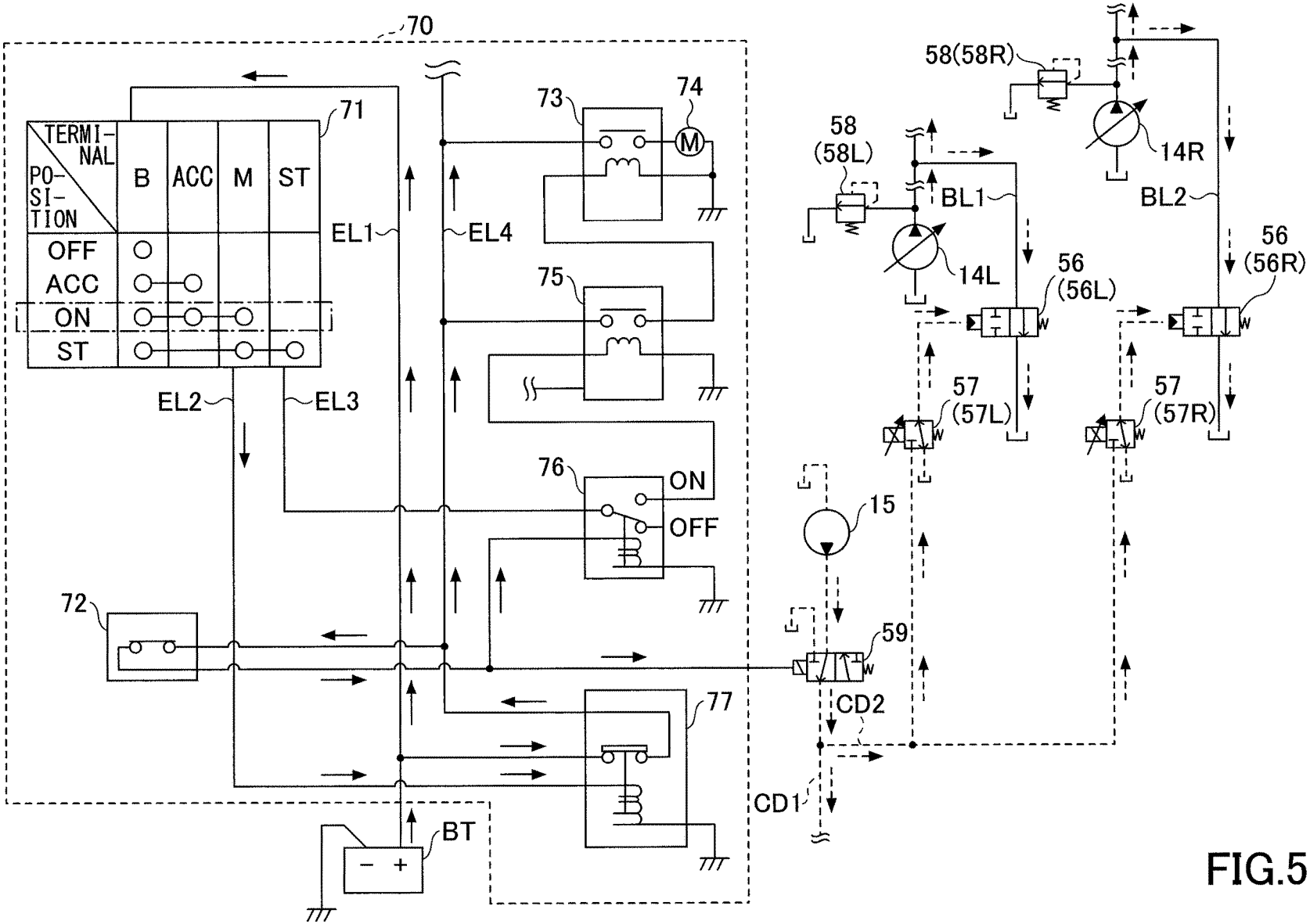
FIG. 5 is a diagram illustrating an example of a state of a hydraulic circuit when the engine is running.

In this state, in a case where the gate lock switch 72 changes to the conductive state which is the working state (for example, in a case where the shovel 100 changes to the working state), the second battery line EL4 and the gate lock valve 59 are connected as illustrated in FIG. 5. When the second battery line EL4 and the gate lock valve 59 are connected, a current flows from the battery BT through the battery relay 77 and the gate lock switch 72 to the gate lock valve 59. As a result, the gate lock valve 59 makes communication between the pilot pump 15 and the oil passages CD1, CD2. When the pilot pump 15 and the oil passage CD2 are brought into communication, the hydraulic oil discharged by the pilot pump 15 can increase the pilot pressure applied to the pilot port of the unified bleed-off valve 56 through the solenoid proportional valve 57, since the solenoid proportional valve 57 maintains the open state with a spring in the non-energized state. Accordingly, the engine start circuit 70 can reduce the opening area of the unified bleed-off valve 56, and can increase the pressure of the hydraulic oil in the center bypass oil passages RC1, RC2. Since the pilot pump 15 and the oil passage CD1 are in communication, when the operator manipulates the manipulating apparatus 26, the engine start circuit 70 can apply the pilot pressure of the oil passage CD1 to the control valve corresponding to the manipulating apparatus 26.

The controller 30 supplies a command current according to manipulation of the manipulating apparatus 26 to the solenoid proportional valve 57 to adjust the pilot pressure applied to the pilot port of the unified bleed-off valve 56, so that the passage areas of the unified bleed oil passages BL1, BL2 can be adjusted. As a result, the controller 30 can achieve a bleed-off flowrate according to manipulation of the manipulating apparatus 26. Furthermore, the controller 30 can appropriately drive the hydraulic actuator corresponding to the manipulating apparatus 26 according to a manipulation situation and the like.

The hydraulic circuit HC hydraulically adjusts the opening of the unified bleed-off valve 56, without relying on the controller 30, in accordance with a switching of the switch position of the key switch 71 (including the ON position and the OFF position) and a switching of the state of the gate lock switch 72 (including the conductive state and the non-conductive state), i.e., the state of the gate lock lever D1 (including the locked state and the lock-released state). Also, the hydraulic circuit HC hydraulically achieves control for the control valve according to manipulation of the manipulating apparatus 26 performed thereafter.

Therefore, even in a case where the solenoid proportional valve 57 fail to electronically operate due to malfunction of the controller 30, malfunction of the solenoid proportional valve 57, and the like, the hydraulic circuit HC can operate the hydraulic actuator in accordance with manipulation of the manipulating apparatus 26. For example, in a case where the solenoid proportional valve 57 of inverse proportional type does not receive a command current from the controller 30, the solenoid proportional valve 57 is maintained at the first position at which opening area (the passage area of the oil passage CD2) is the maximum. Therefore, when a command current is no longer supplied from the controller 30 to the solenoid proportional valve 57, the pilot pressure applied to the pilot port of the unified bleed-off valve 56 increases, and the unified bleed-off valve 56 is set to the second position at which the unified bleed oil passages BL1, BL2 are not in communication.

In this case, the hydraulic oil discharged by the main pump 14 cannot flow through the unified bleed-off valve 56 to the hydraulic oil tank T, and accordingly, the discharge pressure increases. Then, when the discharge pressure attains a predetermined relief pressure, the hydraulic oil discharged by the main pump 14 flows through the relief valve 58 to the hydraulic oil tank T. In this state, for example, when the bucket manipulation lever is manipulated to a closing direction, hydraulic oil having a predetermined relief pressure flows through the control valve 173 to the bottom-side oil chamber of the bucket cylinder 9 to close the bucket 6.

According to this configuration, even in a case where the solenoid proportional valve 57 does not operate electronically, the shovel 100 equipped with the hydraulic circuit HC including the unified bleed-off valve 56 can operate the hydraulic actuator according to manipulation of the manipulating apparatus 26.

For example, a shovel equipped with a unified bleed-off valve of normally-closed type, which is different from the unified bleed-off valve 56 of the normally-open type according to the present embodiment, may fail to start the engine in a case where the unified bleed-off valve cannot be opened by electronic control performed with a controller due to some reason. This is because, with such a configuration, during start-up of the engine, the hydraulic oil discharged by the main pump cannot be discharged to the hydraulic oil tank, and this increases the discharge pressure. In other words, this is because a torque higher than the torque generated by the starter motor is required in order to rotate the engine.

Alternatively, in a case where a shovel equipped with a unified bleed-off valve of the normally-open type fails to close the unified bleed-off valve by electronic control performed with the controller due to some reason, the shovel may be able to start the engine, but may fail to operate the hydraulic actuator. This is because, with such a configuration, even though the manipulating apparatus 26 is manipulated, all the hydraulic oil discharged by the main pump is discharged to the hydraulic oil tank through the unified bleed-off valve of the normally-open type, and as a result, hydraulic oil cannot be supplied to a corresponding hydraulic actuator.

With regard to the above problem, the hydraulic circuit HC provided in the shovel 100 according to the present embodiment is configured so that the discharge pressure of the main pump 14 is equal to or less than a predetermined pressure during start up of the engine 11.

According to this configuration, even in a case where the shovel 100 cannot control the unified bleed-off valve 56 by electronic control performed with the controller 30 due to some reason, the shovel 100 can start the engine 11. Examples of cases where the unified bleed-off valve 56 cannot be controlled by electronic control performed with the controller 30 due to some reason include a malfunction of the controller 30, a malfunction of the solenoid proportional valve 57, or the like.

For example, the unified bleed-off valve 56 is hydraulically configured so that the passage areas of the unified bleed oil passages BL1, BL2 become equal to or more than a predetermined value during start up of the engine 11. According to this configuration, even in a case where the shovel 100 cannot control the unified bleed-off valve 56 by electronic control performed with the controller 30 due to some reason, the hydraulic oil discharged by the main pump 14 can be discharged to the hydraulic oil tank T through the hydraulically operating unified bleed-off valve 56 during start up of the engine 11. Therefore, during start up of the engine 11, the rotation load of the engine 11 can be prevented from excessively increasing due to excessive increase in the pressure of the hydraulic oil in the hydraulic circuit HC. Therefore, the engine 11 can be started reliably by the starter motor 74.

The shovel 100 may have the manipulating apparatus 26 for manipulating the hydraulic actuator and the gate lock lever D1 for switching the manipulating apparatus 26 into either the enabled state or the disabled state. When the gate lock lever D1 makes the enabled state, the unified bleed-off valve 56 may be hydraulically configured so that the passage areas of the unified bleed oil passages BL1, BL2 become less than a predetermined value. According to this configuration, even in a case where the shovel 100 cannot control the unified bleed-off valve 56 by electronic control performed with the controller 30 due to some reason, the shovel 100 can start the engine 11, and can activate the hydraulic actuator after the engine 11 has been started. Therefore, even when the shovel 100 falls into a situation where the unified bleed-off valve 56 cannot be controlled by electronic control performed with the controller 30 due to some reason, the operator of the shovel 100 can operate the shovel 100 to a desired orientation, and can move the shovel 100 to a desired position.

The shovel 100 may have, between the pilot pump 15 and the unified bleed-off valve 56 of the normally-open type, the solenoid proportional valve 57 of inverse proportional type and the gate lock valve 59 operating according to manipulation of the gate lock lever D1 without relying on the controller 30. In other words, the pilot port of the unified bleed-off valve 56 of the normally-open type may be configured to be connected to the pilot pump 15 through the oil passage CD2, in which the solenoid proportional valve 57 of inverse proportional type is arranged, to receive the pilot pressure applied by the hydraulic oil discharged by the pilot pump 15. In addition, between the solenoid proportional valve 57 and the pilot pump 15, the gate lock valve 59 may be arranged as a solenoid selector valve operating in accordance with the gate lock lever D1. According to this configuration, even in a case where the shovel 100 cannot control the unified bleed-off valve 56 by electronic control performed with the controller 30 due to some reason, the shovel 100 can start the engine 11, and can activate the hydraulic actuator after the engine 11 has been started. This is because the unified bleed-off valve 56 is hydraulically configured so that the passage areas of the unified bleed oil passages BL1, BL2 become equal to or more than a predetermined value when the engine 11 has been started. This is also because, irrespective of whether the controller 30 is functioning normally or not, the gate lock valve 59 is configured to make communication between the pilot pump 15 and the oil passages CD1, CD2 when the gate lock switch 72 is changed to the conductive state after the engine has been started.

Figure 6:
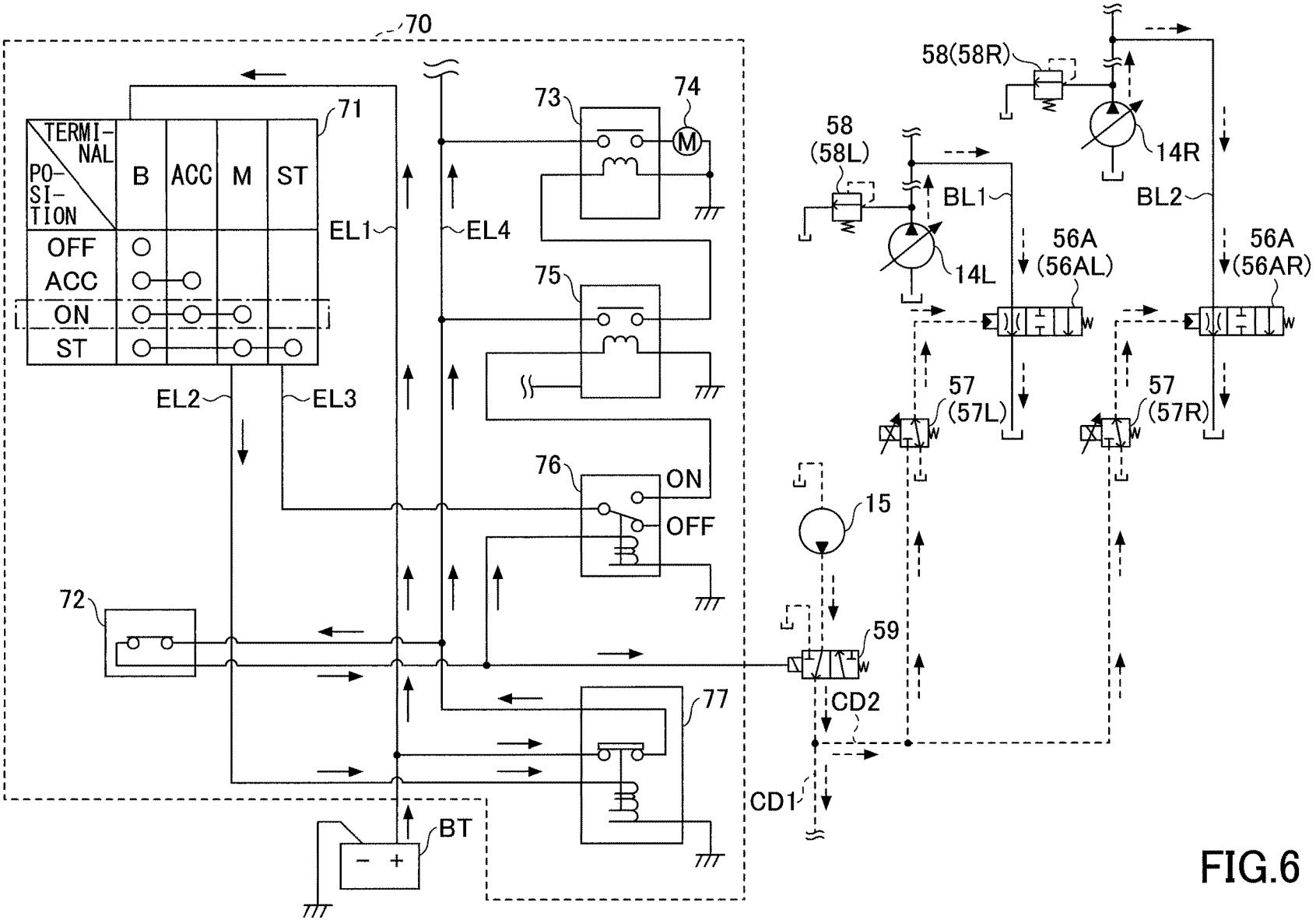
FIG. 6 is a diagram illustrating another example of a hydraulic circuit provided in the shovel.

Subsequently, another example of configuration of a hydraulic circuit HC will be explained with reference to FIG. 6. The hydraulic circuit HC of FIG. 6 differs from the hydraulic circuit HC of FIG. 3 in that the hydraulic circuit HC of FIG. 6 includes a unified bleed-off valve 56A instead of the unified bleed-off valve 56, but the hydraulic circuit HC of FIG. 6 is similar with regard to other features. Therefore, the explanation about similar portions is omitted and different portions are explained in detail.

The unified bleed-off valve 56A is a hydraulic drive valve of normally-open type, and includes a unified bleed-off valve 56AL and a unified bleed-off valve 56AR.

The unified bleed-off valve 56AL is a two port, three-position spool valve capable of controlling a discharge amount (bleed-off flowrate) of the hydraulic oil discharged from the left main pump 14L to the hydraulic oil tank T. In a case where the pilot pressure applied to the pilot port is equal to or less than a predetermined value P1, the unified bleed-off valve 56AL is at a first position, and as the pilot pressure increases beyond the predetermined value P1, the unified bleed-off valve 56AL approaches a second position. In a case where the pilot pressure is a predetermined value P2 (>P1), the unified bleed-off valve 56AL is at the second position, and in a case where the pilot pressure is a predetermined value P3 (>P2), the unified bleed-off valve 56AL is at a third position. In a case where the unified bleed-off valve 56AL is at the first position, the unified bleed-off valve 56AL maximizes the opening area (the passage area of the unified bleed oil passage BL1), and as the unified bleed-off valve 56AL approaches the second position, the unified bleed-off valve 56AL decreases the opening area, and in a case where the unified bleed-off valve 56AL is at the second position, the unified bleed-off valve 56AL shuts off the unified bleed oil passage BL1. In a case where the unified bleed-off valve 56AL is at the third position, the unified bleed-off valve 56AL changes the opening area (the passage area of the unified bleed oil passage BL1) to a predetermined value. This predetermined value is a value less than the opening area at the first position. In a case where the engine 11 is running, i.e., in a case where the main pump 14 is discharging hydraulic oil and where the unified bleed-off valve 56AL is at the third position, the pressure of the hydraulic oil in the hydraulic circuit HC (the discharge pressure of the main pump 14) is maintained at a predetermined pressure (bleed pressure). The predetermined pressure (bleed pressure) is a pressure capable of operating the hydraulic actuator, and is less than a relief pressure of the relief valve 58. The same applies to the unified bleed-off valve 56AR.

According to this configuration, even in a case where the solenoid proportional valve 57 does not operate electronically due to some reason, the hydraulic circuit HC can operate the hydraulic actuator in accordance with manipulation of the manipulating apparatus 26. In this case, the solenoid proportional valve 57 of inverse proportional type is maintained at the first position at which the opening area (the passage area of the oil passage CD2) becomes the maximum. Accordingly, the pilot pressure applied to the pilot port of the unified bleed-off valve 56A increases, and the unified bleed-off valve 56A is set at the third position as illustrated in FIG. 6.

In this case, the hydraulic oil discharged by the main pump 14 flows through the unified bleed-off valve 56A to the hydraulic oil tank T while generating a predetermined bleed pressure. In this state, for example, when the bucket manipulation lever is manipulated to a closing direction, hydraulic oil having the predetermined bleed pressure flows through the control valve 173 to the bottom-side oil chamber of the bucket cylinder 9, which closes the bucket 6.

According to this configuration, even in a case where the solenoid proportional valve 57 does not operate electronically, the operator of the shovel 100 equipped with the hydraulic circuit HC including the unified bleed-off valve 56A can start the engine 11, and can activate the hydraulic actuator after the engine 11 has been started.

Figure 7:
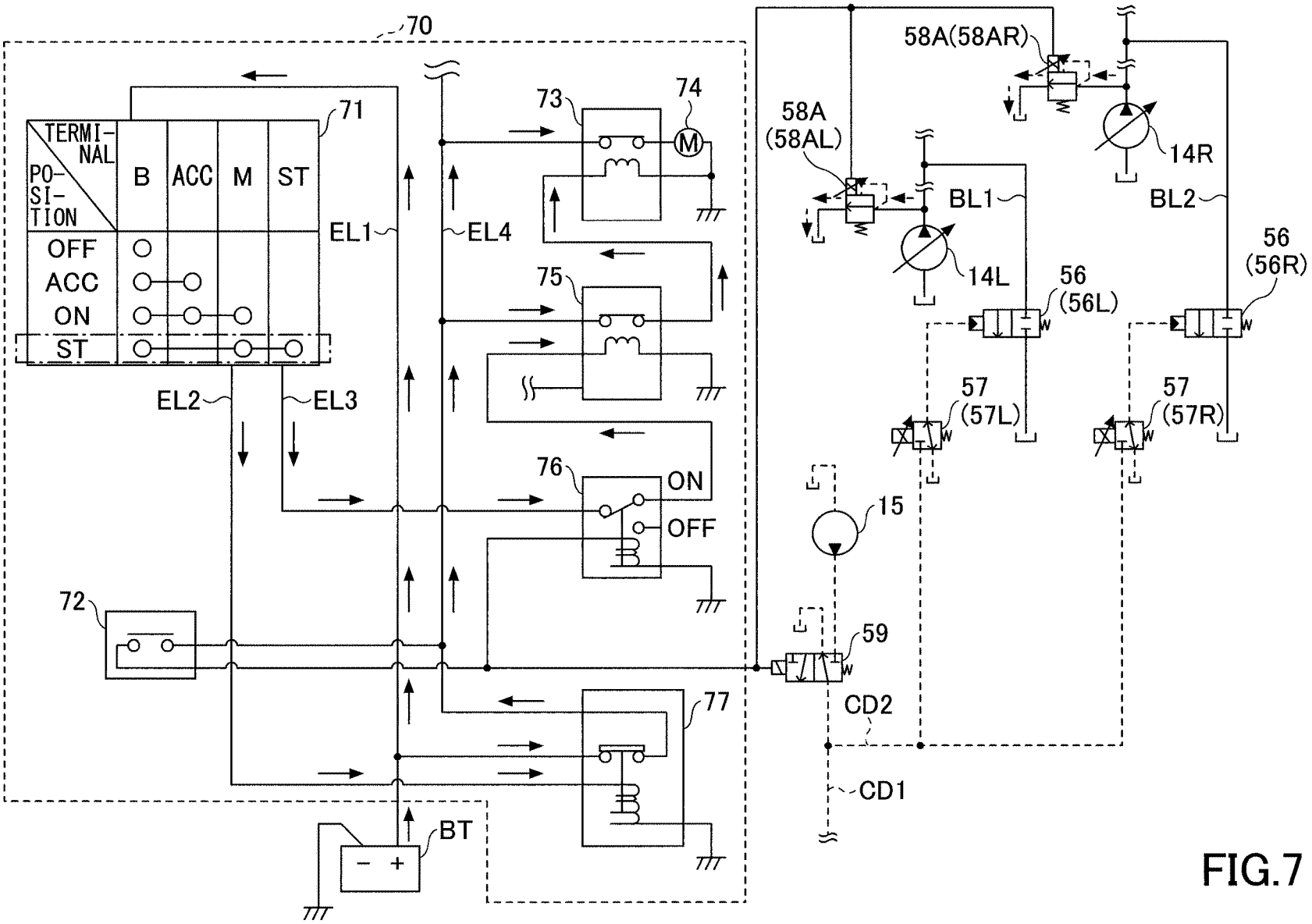
FIG. 7 is a diagram illustrating still another example of a hydraulic circuit provided in the shovel.

Subsequently, another example of configuration of a hydraulic circuit will be explained with reference to FIG. 7. The hydraulic circuit of FIG. 7 is different from the hydraulic circuit of FIG. 3 in that the hydraulic circuit of FIG. 7 includes a variable relief valve 58A instead of the relief valve 58, includes a unified bleed-off valve 56 of normally-closed type instead of the unified bleed-off valve 56 of the normally-open type, and includes a solenoid proportional valve 57 of proportional type instead of the solenoid proportional valve 57 of inverse proportional type, but the hydraulic circuit of FIG. 7 is similar with regard to other features. Therefore, the explanation about similar portions is omitted and different portions are explained in detail.

The variable relief valve 58A opens when the pressure of the hydraulic oil at the primary side becomes equal to or more than a predetermined relief pressure. In the example of FIG. 7, the variable relief valve 58A includes a variable relief valve 58AL and a variable relief valve 58AR. When the pressure of the hydraulic oil of the center bypass oil passage RC1 becomes equal to or more than the predetermined relief pressure, the variable relief valve 58AL opens to discharge the hydraulic oil in the center bypass oil passage RC1 to the hydraulic oil tank T. When the pressure of the hydraulic oil of the center bypass oil passage RC2 becomes equal to or more than a predetermined relief pressure, the variable relief valve 58AR opens to discharge hydraulic oil in the center bypass oil passage RC2 to the hydraulic oil tank T.

Like the gate lock valve 59, when the key switch 71 at the ST position and the gate lock switch 72 is in the non-conductive state, the variable relief valve 58A is configured not to be applied with a voltage. Conversely, when the key switch 71 is at the ON position and the gate lock switch 72 is in the conductive state, the variable relief valve 58A is configured to be applied with a voltage.

When the variable relief valve 58A is not applied with a voltage, the variable relief valve 58A is configured so that the relief pressure becomes a predetermined lower limit value, and when the variable relief valve 58A is applied with a voltage, the variable relief valve 58A is configured so that the relief pressure becomes a predetermined upper limit value.

According to this configuration, when the key switch 71 is switched to the ST position when the gate lock switch 72 is in the non-conductive state which is the non-working state (for example, the shovel 100 is in the non-working state) as illustrated in FIG. 7, the starter motor 74 rotates the rotation shaft of the engine 11. At this occasion, the unified bleed-off valves 56L, 56R of normally-closed type are set to the closed position for breaking the communication through the unified bleed oil passages BL1, BL2. In other words, the unified bleed-off valves 56L, 56R are configured so that the passage areas of the unified bleed oil passages BL1, BL2 are less than a predetermined value in the non-working state. Therefore, in a case where the main pump 14 rotates in accordance with rotation of the engine 11, the hydraulic oil discharged by the main pump 14 cannot pass through the unified bleed oil passages BL1, BL2. In this state, a voltage is not applied to the variable relief valve 58A, and accordingly, the relief pressure is a predetermined lower limit value. Accordingly, when the discharge pressure attains a predetermined relief pressure (lower limit value), the hydraulic oil discharged by the main pump 14 is discharged through the variable relief valve 58A to the hydraulic oil tank T. Therefore, the discharge pressure of the main pump 14 does not increase excessively, and the engine load does not increase excessively. As a result, the starter motor 74 can rotate the rotation shaft of the engine 11 at a predetermined rotation speed or more to start the engine 11.

When the gate lock switch 72 is switched to the conductive state in a state in which the key switch 71 has been switched to the ON position after the engine 11 had been started, a current flows from the battery BT to the gate lock valve 59 and the variable relief valve 58A. As a result, the gate lock valve 59 makes communication between the pilot pump 15 and the oil passages CD1, CD2. When the pilot pump 15 and the oil passage CD2 are brought into communication, the hydraulic oil discharged by the pilot pump 15 can increase the pilot pressure applied to the pilot port of the unified bleed-off valve 56 through the solenoid proportional valve 57 to operate the unified bleed-off valve 56. The controller 30 supplies a command current according to manipulation of the manipulating apparatus 26 to the solenoid proportional valve 57, so that the controller 30 can adjust the passage areas of the unified bleed oil passages BL1, BL2 by adjusting the pilot pressure applied to the pilot port of the unified bleed-off valve 56. In this state, a voltage is applied to the variable relief valve 58A, and accordingly, the relief pressure is a predetermined upper limit value. As a result, the hydraulic oil discharged by the main pump 14 passes through the unified bleed-off valve 56, not through the variable relief valve 58A, to be discharged to the hydraulic oil tank T while achieving bleed-off flowrate according to manipulation of the manipulating apparatus 26.

In the example of FIG. 7, even in a case where the solenoid proportional valve 57 does not operate electronically due to a malfunction of the controller 30, a malfunction of the solenoid proportional valve 57, or the like, the hydraulic circuit HC can operate the hydraulic actuator in accordance with manipulation of the manipulating apparatus 26. In this case, the solenoid proportional valve 57 of proportional type is maintained at the closed position at which the oil passage CD2 is shut off. Therefore, the pilot pressure applied to the pilot port of the unified bleed-off valve 56 does not increase, and the unified bleed-off valve 56 of normally-closed type is set to the closed position for shutting off the unified bleed oil passages BL1, BL2.

Since the hydraulic oil discharged by the main pump 14 cannot flow through the unified bleed-off valve 56 to the hydraulic oil tank T, the discharge pressure is increased. When the discharge pressure attains a predetermined relief pressure (upper limit value), the hydraulic oil flows through the variable relief valve 58A to the hydraulic oil tank T. In this state, for example, when the bucket manipulation lever is manipulated to the closing direction, the hydraulic oil having a predetermined relief pressure (upper limit value) flows through the control valve 173 to the bottom-side oil chamber of the bucket cylinder 9 to close the bucket 6.

According to this configuration, even in a case where the solenoid proportional valve 57 does not operate electronically, the operator of the shovel 100 equipped with the hydraulic circuit HC of FIG. 7 can operate the hydraulic actuator.

In this manner, the shovel 100 may have the variable relief valve 58A that opens when the pressure of the hydraulic oil in the hydraulic circuit HC becomes equal to or more than a predetermined relief pressure. In addition, the variable relief valve 58A may be configured so that the relief pressure becomes a predetermined lower limit value during start up of the engine 11. The predetermined lower limit value is less than a relief pressure of the variable relief valve 58A when the engine 11 is running. According to this configuration, even in a case where the shovel 100 cannot control the unified bleed-off valve 56 by electronic control performed with the controller 30 due to some reason, the shovel 100 can discharge the hydraulic oil discharged by the main pump 14 through the variable relief valve 58A to the hydraulic oil tank T during start up of the engine 11. Therefore, during start up of the engine 11, the shovel 100 can prevent excessively increasing the rotation load of the engine 11 due to excessive increase in the pressure of the hydraulic oil in the hydraulic circuit HC. Therefore, the shovel 100 can reliably start the engine 11 by the starter motor 74.

The shovel 100 may include the manipulating apparatus 26 for manipulating the hydraulic actuator, the gate lock lever D1 for switching the manipulating apparatus 26 into either the enabled state or the disabled state, and the variable relief valve 58A configured to change the relief pressure in accordance with the state of the gate lock lever D1. When the gate lock lever D1 makes the enabled state, the variable relief valve 58A may be hydraulically configured so that the relief pressure becomes a predetermined upper limit value. According to this configuration, even in a case where the shovel 100 cannot control the unified bleed-off valve 56 by electronic control performed with the controller 30 due to some reason, the shovel 100 can start the engine 11, and can activate the hydraulic actuator after the engine 11 has been started.

In the embodiment described above, the start circuit of the shovel is provided separately from the controller 30, but may be provided in the controller 30.

The solenoid proportional valve 57 may be configured to be maintained at the closed state with a spring in the non-energized state, and to be switched into either an open or closed state in synchronization with manipulation of the manipulating apparatus 26. In this case, the start circuit of the shovel may switch the shovel into a non-working state or a working state on the basis of motion of the manipulating apparatus 26. Further, whether the shovel is in the non-working state or the working state may be determined on the basis of images captured by a camera provided in the cab 10, serving as an operator room, to capture images of motion of the operator.

Accordingly, the above embodiment provides a shovel provided with a unified bleed-off valve capable of reliably starting the engine.

The preferred embodiment of the present invention has been described above in detail. However, the present invention is not limited to the embodiment described above. Various modifications and substitutions can be applied to the above-described embodiment without departing from the scope of the present invention. Each of the features described with reference to the above-described embodiment may be appropriately combined unless such combination is technically contradictory.

What is claimed is:

1. A shovel comprising:

a lower traveling body;

an upper turning body mounted on the lower traveling body in a turnable manner;

a power source provided in the upper turning body;

a hydraulic pump and a hydraulic oil tank provided in the upper turning body;

a plurality of hydraulic actuators driven by the hydraulic pump;

a hydraulic circuit connected to the hydraulic pump, wherein the hydraulic circuit includes:

a plurality of control valves configured to control flows of hydraulic oil between the hydraulic pump and the plurality of hydraulic actuators; and a unified bleed-off valve configured to collectively control bleed-off flowrates of the plurality of control valves, and the hydraulic circuit is configured to set an opening area of the unified bleed-off valve to a predetermined value so that a discharge pressure of the hydraulic pump becomes equal to or less than a predetermined pressure during start-up of the power source; and a processor configured to adjust the opening area of the unified bleed-off valve according to an operating state of the plurality of hydraulic actuators such that the opening area of the unified bleed-off valve is less than the predetermined value to generate a bleed pressure, when the power source is running and the plurality of hydraulic actuators are enabled.

2. The shovel according to claim 1, wherein the unified bleed-off valve causes a passage area of a unified bleed oil passage to be equal to or more than a predetermined value during the start-up of the power source.

3. The shovel according to claim 1, wherein the unified bleed-off valve causes a passage area of a unified bleed oil passage to be less than a predetermined value in a non-working state.

4. The shovel according to claim 1, wherein the opening area of the unified bleed-off valve changes in accordance with an amount of manipulation of a manipulating apparatus for operating at least one of the plurality of hydraulic actuators.

5. The shovel according to claim 1, further comprising a variable relief valve that opens in a case where a pressure of the hydraulic oil in the hydraulic circuit becomes equal to or more than a threshold relief pressure, wherein the threshold relief pressure of the variable relief valve becomes a predetermined lower limit value during the start-up of the power source.

6. The shovel according to claim 5, further comprising:

a manipulating apparatus for operating at least one of the plurality of hydraulic actuators; and a gate lock lever for switching the manipulating apparatus to an enabled state or a disabled state, wherein when the manipulating apparatus is switched to the enabled state by the gate lock lever, the threshold relief pressure of the variable relief valve becomes a predetermined upper limit value.

7. The shovel according to claim 1, further comprising:

a manipulating apparatus for operating at least one of the plurality of hydraulic actuators; and a gate lock lever for switching the manipulating apparatus to an enabled state or a disabled state, wherein when the manipulating apparatus is switched to the enabled state by the gate lock lever, the unified bleed-off valve causes a passage area of a unified bleed oil passage to be less than a predetermined value.

8. The shovel according to claim 7, wherein the unified bleed-off valve is of normally-open type, a pilot port of the unified bleed-off valve of the normally-open type is configured to be connected to a pilot pump through an oil passage, in which a solenoid proportional valve of inverse proportional type is arranged, to receive a pilot pressure applied by hydraulic oil discharged by the pilot pump, and a solenoid selector valve configured to operate in synchronization with the gate lock lever is arranged between the solenoid proportional valve and the pilot pump.

9. A shovel comprising:

a lower traveling body;

an upper turning body mounted on the lower traveling body in a turnable manner;

a power source provided in the upper turning body;

a hydraulic pump and a hydraulic oil tank provided in the upper turning body;

a plurality of hydraulic actuators driven by the hydraulic pump;

a hydraulic circuit connected to the hydraulic pump, wherein the hydraulic circuit includes:

a plurality of control valves configured to control flows of hydraulic oil between the hydraulic pump and the plurality of hydraulic actuators; and a unified bleed-off valve configured to collectively control bleed-off flowrates of the plurality of control valves, and the hydraulic circuit is configured so that a discharge pressure of the hydraulic pump becomes equal to or less than a predetermined pressure during start-up of the power source;

a processor configured to change an opening area of the unified bleed-off valve, based on an amount of manipulation of a manipulating apparatus for operating at least one of the plurality of hydraulic actuators; and a start circuit configured to control, separately from the processor, an opening of the unified bleed-off valve during the start-up of the power source.

* * * * *